US008033359B2

(12) United States Patent
Ichikawa et al.

(10) Patent No.: US 8,033,359 B2
(45) Date of Patent: Oct. 11, 2011

(54) INTAKE SOUND ADJUSTING DEVICE

(75) Inventors: Takayuki Ichikawa, Hamamatsu (JP); Tatsuro Isobe, Hamamatsu (JP)

(73) Assignee: Roki Co., Ltd., Shizuoka (JP)

( * ) Notice: Subject to any disclaimer, the term of this patent is extended or adjusted under 35 U.S.C. 154(b) by 0 days.

(21) Appl. No.: 12/714,795

(22) Filed: Mar. 1, 2010

(65) Prior Publication Data

US 2010/0224439 A1 Sep. 9, 2010

(30) Foreign Application Priority Data

Mar. 5, 2009 (JP) ..... 2009-051893

(51) Int. Cl.
*F02M 35/00* (2006.01)

(52) U.S. Cl. ..... 181/229; 181/212; 181/241; 181/254; 181/237; 123/184.53; 123/184.54; 123/184.55; 123/184.56; 123/184.57

(58) Field of Classification Search ..... 181/212, 181/229, 237, 254, 241, 287; 123/184.53, 123/184.54, 184.55, 184.56, 184.57; 52/144, 52/145

See application file for complete search history.

(56) References Cited

U.S. PATENT DOCUMENTS

| | | | | |
|---|---|---|---|---|
| 4,903,486 | A * | 2/1990 | Finkle | 60/324 |
| 5,917,161 | A * | 6/1999 | Fuhrmann | 181/237 |
| 7,441,527 | B2 * | 10/2008 | Hayashi et al. | 123/184.53 |
| 7,487,857 | B2 * | 2/2009 | Wolf | 181/247 |
| 7,506,626 | B2 * | 3/2009 | Sasaki et al. | 123/184.53 |
| 2005/0155816 | A1 * | 7/2005 | Alcini et al. | 181/237 |
| 2006/0249328 | A1 * | 11/2006 | Ichikawa et al. | 181/254 |
| 2009/0000587 | A1 * | 1/2009 | Seko et al. | 123/184.57 |

FOREIGN PATENT DOCUMENTS

| | | |
|---|---|---|
| JP | 2005-139982 | 6/2005 |
| JP | 2006-083787 | 3/2006 |

* cited by examiner

*Primary Examiner* — Forrest M Phillips
(74) *Attorney, Agent, or Firm* — Young & Thompson

(57) ABSTRACT

An intake sound adjusting device includes an intake passage, a tubular branch passage branched from the intake passage, and an oscillating member disposed within the branch passage, in which the oscillating member has an oscillating portion disposed so as to close an interior of the branch passage and a controlling portion extending from the oscillating portion in a direction along an extending direction of the branch passage.

8 Claims, 7 Drawing Sheets

INTAKE SOUND ADJUSTING DEVICE

BACKGROUND OF THE INVENTION

1. Field of the Invention

The present invention relates to an intake sound adjusting device particularly provided with a mechanism capable of generating an intake sound having a specific frequency band.

2. Description of Related Art

In an internal combustion engine, pulsating (pulsation) sound or noise of intake air introduced into an internal combustion engine due to reciprocating motion of a piston or an intake valve disposed within the internal combustion engine. Since this intake pulsating sound has a wide band range, this is generally considered as "noise". In order to reduce such intake pulsating sound as noise, a resonator or like is generally disposed in an intake passage to thereby reduce noise of the specific frequency range calculated on the basis of the Helmholtz's Resonance Theory.

However, for some cars such as called "sporty cars", it is required to generate a vigorous powerful intake sound in a vehicle interior in order to produce an acceleration feel, and in order to satisfy such requirement, in the known art, there is provided a sound quality controlling device capable of producing a powerful intake sound in the vehicle interior only by amplifying a desired frequency band region or area of the intake sound of the wide band range or area.

For the sound quality controlling device mentioned above, prior art provides some sound quality controlling devices in which various attempts have been made for the purpose of tuning a sound pressure characteristic of a desired frequency band.

For example, Japanese Patent Laid-open Publication No. 2005-139982 (Patent Document 1) discloses a sound quality controlling device equipped with a resonator, which is provided with a resonator body (resonating member) oscillating in response to intake air pulsation in a intake unit, a volume chamber connected to the intake unit through the resonating body, and a volume chamber opening section communicating the interior space of the volume chamber with an external side. The interior space of the volume chamber and the interior of the intake unit is sectioned by the resonator body, and by the oscillation of the resonator body, the sound pressure of the specific frequency band area is released externally from the volume chamber opening section.

Furthermore, an intake device disclosed in Japanese Patent Laid-open Publication No. 2006-83787 (Patent Document 2) is provided with an intake passage for introducing sucked air into the internal combustion engine and a resonator passage branched from the intake passage, in which the resonator passage has one end opened to atmosphere and the other end connected to the intake passage. The resonator passage has a length set to be suitable for applying sound pressure of the specific frequency band area to the intake (sucked) air.

However, according to the structures or constructions of the sound quality controlling device disclosed in the Patent Document 1 and the intake device disclosed in the Patent Document 2, there may cause a case where a sound in an area other than the specific frequency band area, which constitute cause or factor of an offensive loud noise or a vehicle exterior noise. Moreover, in a case of changing the specific frequency band in the sound quality tuning operation, it is obliged to re-design volume or size of the volume chamber and the resonator, which makes it difficult to easily perform the sound quality tuning.

SUMMARY OF THE INVENTION

The present invention was conceived in consideration of the circumstances encountered in the prior art such as mentioned above, and an object of the present invention is to provide an intake sound adjusting device capable of releasing a specific frequency band and easily performing a sound quality tuning even with a simple structure.

The above and other objects can be achieved according to the present invention by providing an intake sound adjusting device comprising: an intake passage; a tubular branch passage branched from the intake passage; and an oscillating member disposed within the branch passage, wherein the oscillating member has an oscillating portion disposed so as to close an interior of the branch passage and a controlling portion extending from the oscillating portion in a direction along an extending direction of the branch passage.

In the above aspect, the embodiments may be preferred.

It may be desired that the controlling portion extends from the oscillating portion toward the intake passage.

The oscillating portion may be changed in an arranging position inside the branch passage along the extending direction thereof.

It may be desired that the oscillating portion has a length to be changed along the extending direction of the branch passage.

It may be desired that the oscillating portion has a conical shape projecting from an inner wall side of the branch passage toward the intake passage.

It may be desired that the oscillating portion is formed into flat-plate shape vertically intersecting the extending direction of the branch passage.

It may be desired that at least one of the oscillating portion and the controlling portion is formed of resin material or rubber.

According to the intake sound adjusting device of the present invention of the structures mentioned above, the oscillating member having the controlling portion extending along the extending direction of the branch passage is provided. The controlling portion is oscillated only in the specific frequency band, so that the sound in the specific frequency band can be generated. Furthermore, the frequency band of the intake sound to be generated can be easily changed by changing the position of the oscillating member in the branch passage, thus easily performing the sound quality tuning.

The nature and further characteristic features of the present invention will be made clearer from the following description made with reference to the accompanying drawings.

DETAILED DESCRIPTION OF PREFERRED EMBODIMENT

A preferred embodiment of the present invention will be described hereunder with reference to the accompanying drawings. It is further to be noted that the described embodiment does not necessarily limit the invention recited in appended claims and all combination of characteristic features explained in the embodiment is not necessarily essential for the solution of the invention.

Figure 1:
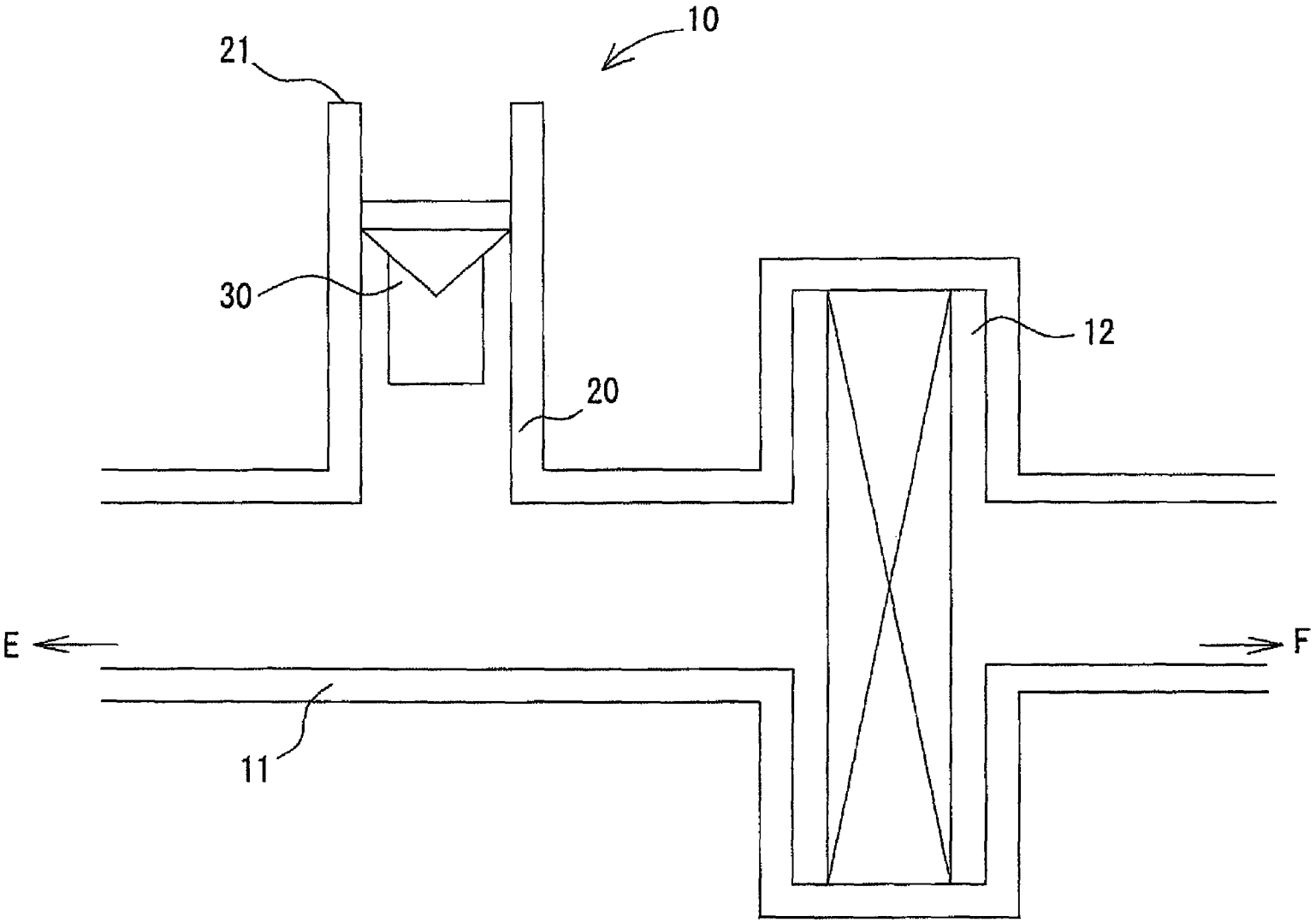
FIG. 1 is an illustration showing a configuration of an intake sound adjusting device according to one embodiment of the present invention.

With reference to FIG. 1, an internal combustion engine E includes an intake passage or channel 11 in which an air cleaner 12 is disposed, and an external (ambient) air introduced through an intake port F is filtrated by the air cleaner to filtrate dust and dirt, and the filtrated air is introduced into the internal combustion engine E. The air filter 12 is provided with a filter member formed of a filter element or medium such as non-woven cloth or fabric, and the filter member is formed so as to provide various shapes such as pleated-sheet shape to increase a filtrating area.

An intake sound adjusting device 10 according to an embodiment of the present invention includes a tubular branch passage (channel) 20 branched from the intake passage (channel) 11 so as to extent toward a clean side of the intake passage 11 (downstream side of the air cleaner 12) and an oscillating member 30 disposed within the branch passage 20.

Figure 2:
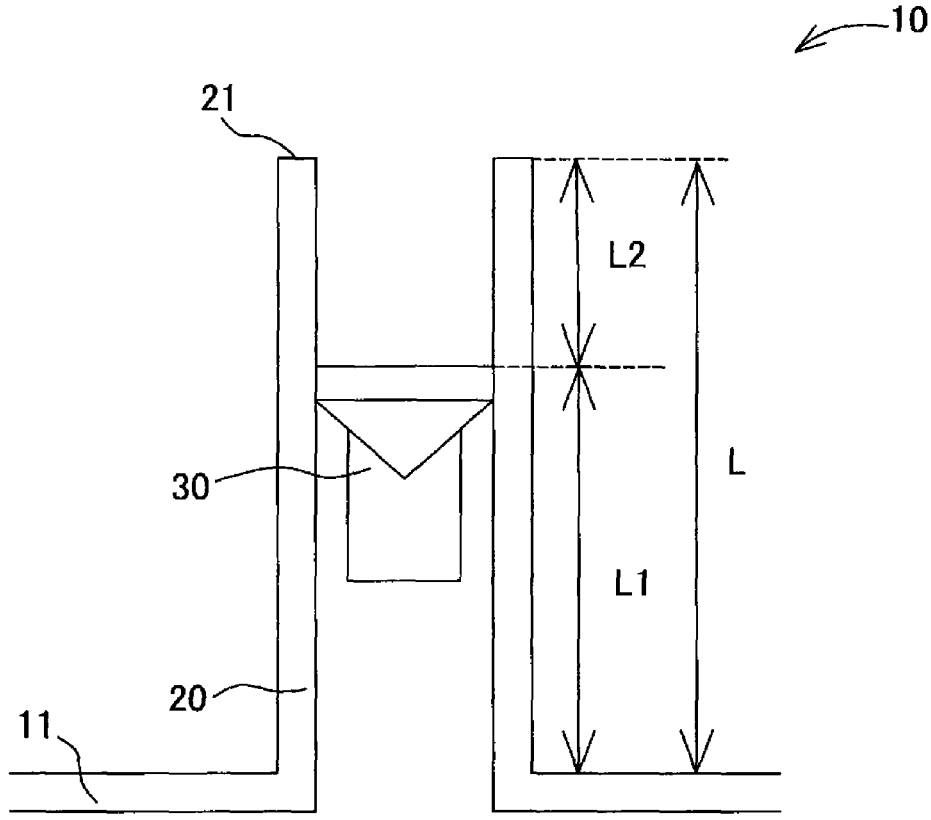
FIG. 2 is an illustration showing a schematic structure of the intake sound adjusting device according to the present invention.
Figure 3:
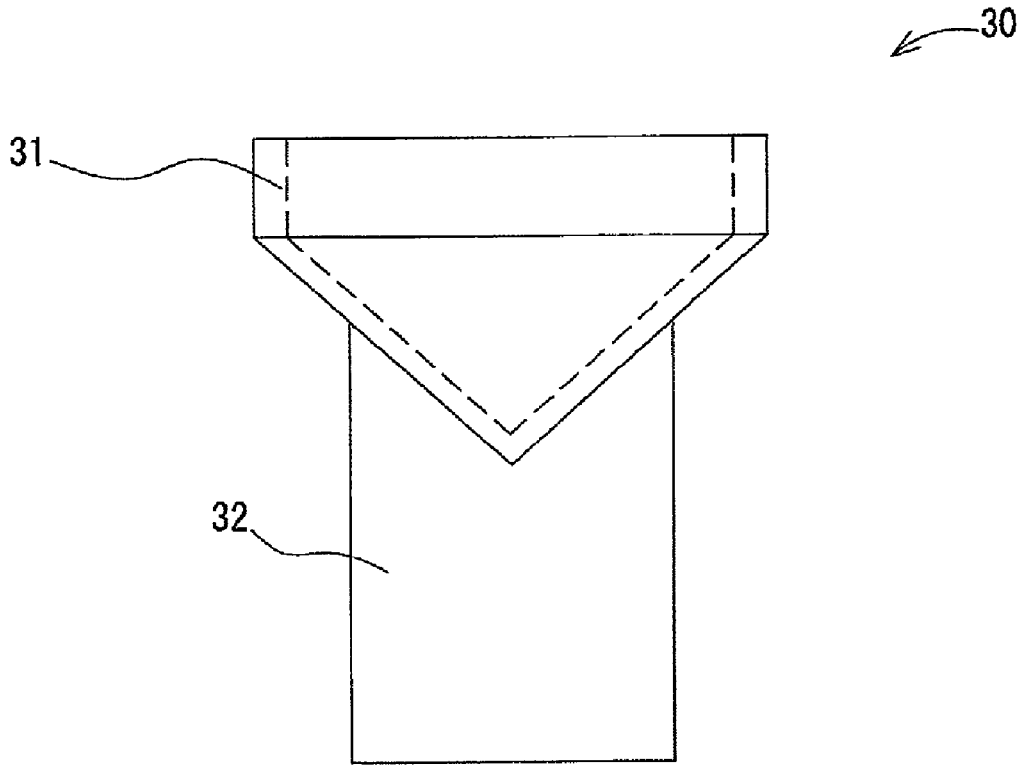
FIG. 3 is an illustration showing a structure of an oscillator of the intake sound adjusting device according to the present invention.

As shown in FIG. 2, the oscillating member 30 is inserted into the branch passage 20 through the open end (or opened end or end opening) 21 by a distance (length) L2, and as further shown in FIG. 3, the oscillating member 30 is provided with an oscillating portion 31 having a shape suitable for closing the branch passage 20 and a controlling portion 32 in shape of flat plate extending toward the extending direction of the branch passage 20 from the oscillating portion 31.

The oscillating portion 31 has a conical shape projecting toward the intake passage side 11 and is formed in a hollow corn shape opened in the open end 21 of the branch passage 20. The oscillating portion 31 has an outer configuration substantially identical to the sectional shape of the branch passage 20 so as to close the interior of the branch passage 20 to thereby prevent dust and dirt from entering the interior of the branch passage 20 through the open end 21 thereof.

The controlling portion 32 has a length in its width direction smaller than an inner diameter of the branch passage 20 so as to prevent the controlling portion itself from oscillating. The controlling portion 32 has a length along the extending direction of the branch passage 20 may be appropriately set so that the controlling portion 32 is oscillated with a specific frequency. In addition, the controlling portion 32 is formed on the side of the intake passage 11 of the oscillating portion 31. Further, the oscillating member 30 may be formed of rubber, synthetic resin or other materials as far as it can be oscillated in response to a specific frequency.

Figure 4:
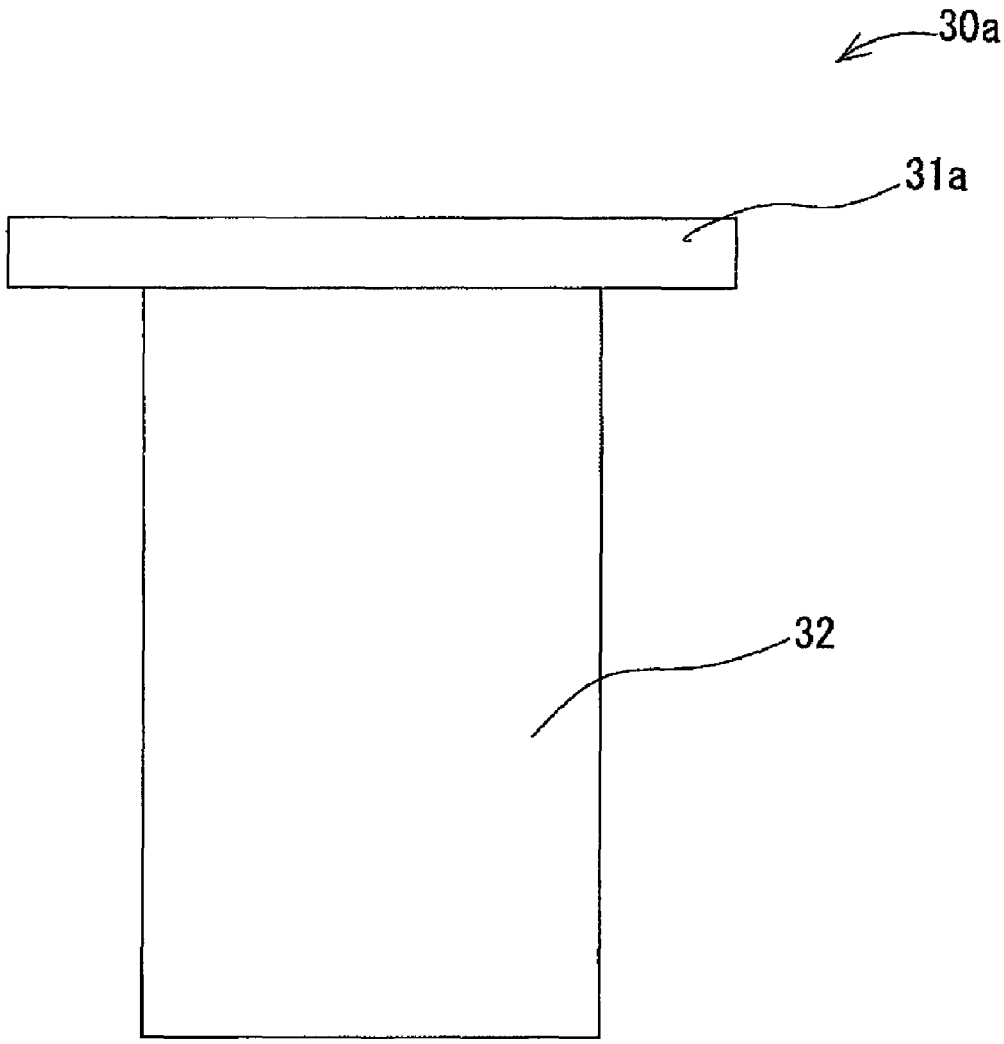
FIG. 4 is an illustration showing a structure of a modified oscillator of the intake sound adjusting device according to the present invention.
Figure 5:
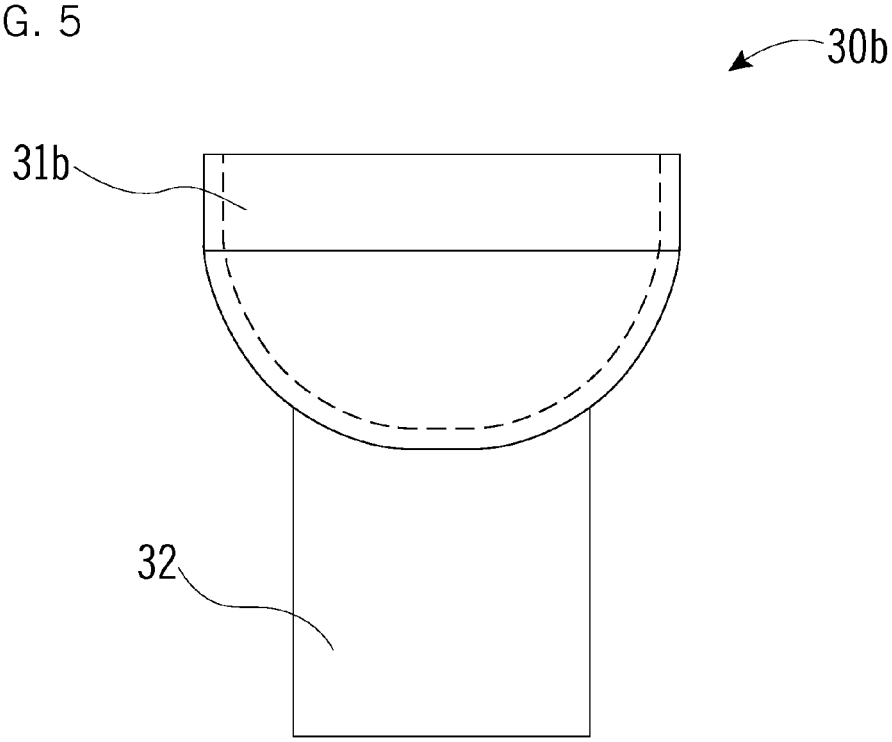
FIG. 5 is an illustration showing a structure of another modified oscillator of the intake sound adjusting device according to the present invention.

It is further to be noted that the oscillating portion 31 of the described embodiment may be various shapes without limiting to the conical shape mentioned above, such as for example, as shown in FIG. 4, it may be formed as flat plate shape vertically intersecting the extending direction of the branch passage 20, or as shown in FIG. 5, it may be formed as hollow bowl shape opened to the open end 21 of the branch passage 20.

A part of the intake pulsating sound generated in the internal combustion engine E is introduced into the branch passage 20 branched from the intake passage 11 before deadening (silencing) the pulsating sound by a silencer such as resonator. In this branch passage 20, there is arranged the oscillating member 30 provided with the controlling portion 32 so that the controlling portion 32 is oscillated by the specific frequency by the intake pulsating sound introduced from the intake passage 11, and this oscillation is transferred to the oscillating portion 31 to thereby release only the specific frequency from the open end 21 of the branch passage 20.

Hereunder, a result in an experiment of the intake sound adjusting device 10 according to the present embodiment will be explained with reference to experimental examples.

Figure 6:
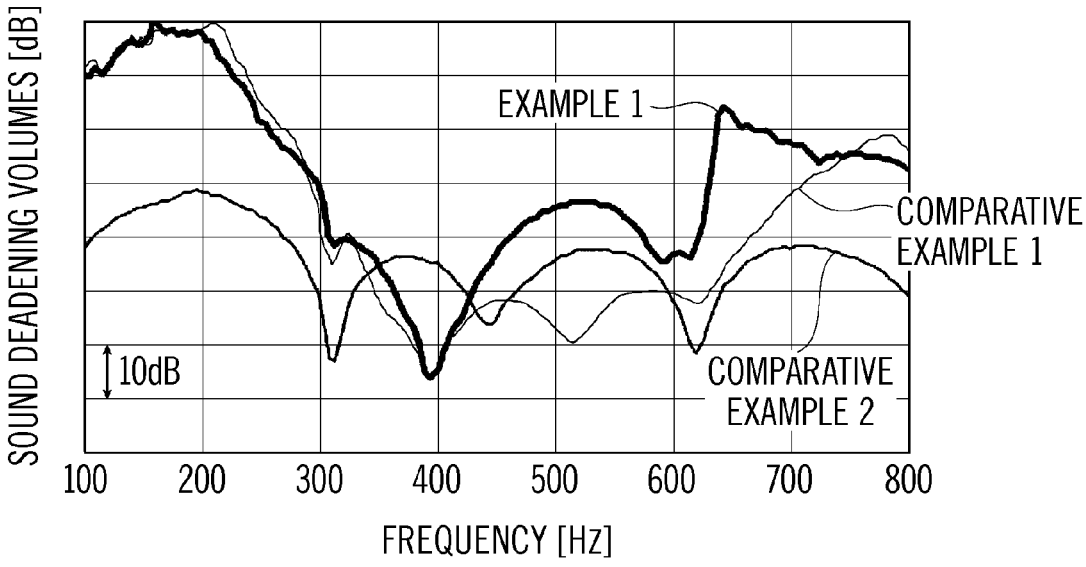
FIG. 6 is a graph representing a result of experiment performed by using the intake sound adjusting device according to the present invention.

FIG. 6 is a graph representing a relationship between a frequency and a sound deadening (silencing) volume as a result of an experiment in a case where white noises generated from a noise source disposed on the side of the internal combustion engine E.

With reference to FIG. 6, in an Example 1 represents a result in a case where the frequency and the sound deadening volume were measured at the open end 21 of the branch passage 20 by using the oscillating member 30 provided with the conical-shaped oscillating portion 31 shown in FIG. 3. On the other hand, a Comparative Example 1 represents a result in a case where the frequency and the sound deadening volume were measured at the open end 21 by closing the branch passage 20 with a thin film not provided with a controlling portion of the structure well known in the conventional art. A Comparative Example 2 represents a result in a case where the frequency and the sound deadening volume were measured at the intake port F of the intake passage 11. Further, in this experiment, the sound deadening volume was measured at the intake port F without arranging any silencer such as resonator.

As can be seen from FIG. 6, in the Example 1 and the Comparative Example 1, the sound deadening volumes are reduced near the frequency of 400 Hz as specific frequency in comparison with the Comparative Example 2, and on the other hand, the sound volume becomes large in that frequency band. Further, with the sound deadening volume in the frequency range more than 400 Hz, the sound deadening volume in the Example 1 is lager than that in the Comparative Example 1, thus suppressing the sound volume of frequency band ranges or areas other than the specific frequency band range or area.

Next, a method for tuning a sound quality of an intake pulsating sound by adjusting the specific frequency will be described with reference to the results of the experiments.

Figure 7:
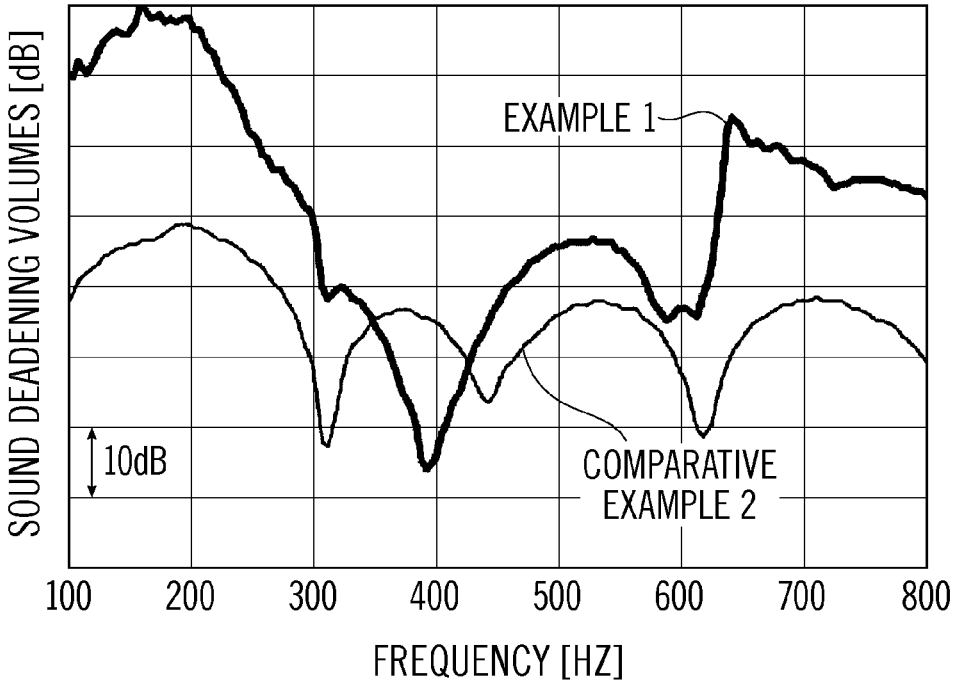
FIG. 7 is a graph representing a result of experiment for adjusting frequency of the intake sound adjusting device according to the present invention.
Figure 8:
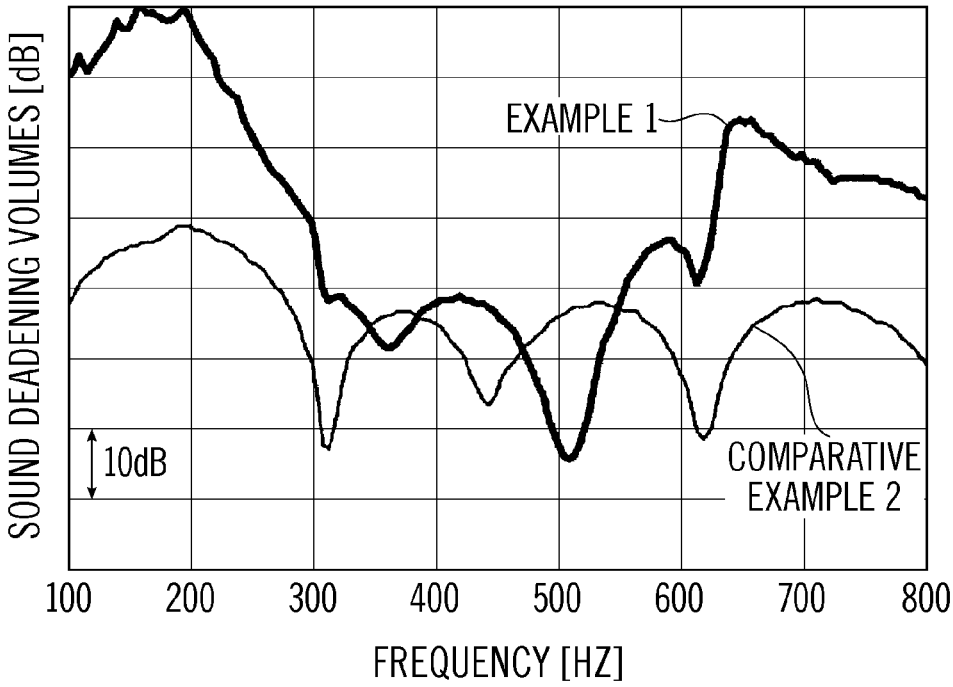
FIG. 8 is a graph also representing a result of experiment for adjusting frequency of the intake sound adjusting device according to the present invention.

FIGS. 7 and 8 are graphs representing a relationship between the frequency and the sound deadening volume in a case where the inserting position of the oscillating member 30 used for the Example 1 within the branch passage 20 was changed. Herein, the experiment result shown in FIG. 7 was obtained by adjusting the position of the oscillating member 30 so as to satisfy the equation "L1<L2", and the experiment result shown in FIG. 8 was obtained by adjusting the position of the oscillating member 30 so as to satisfy the equation "L1>L2". In FIG. 2, L2 is a distance (length) from the open end 21 of the branch passage 20 to the top portion of the oscillating portion 31 of the oscillating member 30 inserted in the branch passage 20, L1 is a distance (length) from the top portion of the oscillating portion 31 of the oscillating member 30 inserted in the branch passage 20 to the branched portion from the intake passage 11, and L is a total length of the branched passage 20 (L=L1+L2).

As can be seen from the results of the experiments shown in FIGS. 7 and 8, the specific frequency can be adjusted by changing the inserting position (length) L2 of the oscillating member 30 within the branch passage 20. More specifically, in an arrangement in which the oscillating member 30 is deeply inserted into the branch passage 20 toward the intake passage 11 side so as to satisfy the equation "L1<L2", the specific frequency can be adjusted to a low frequency range, and on the other hand, in an arrangement in which the oscillating member 30 is shallowly inserted into the branch passage 20 near the open end 21 side so as to satisfy the equation "L1>L2", the specific frequency can be adjusted to a high frequency range. Further, it is to be noted that ratio between the L1 and L2 can be optionally changed and the specific frequency can be adjusted by changing the entire length L of the branch passage 20.

Figure 9:
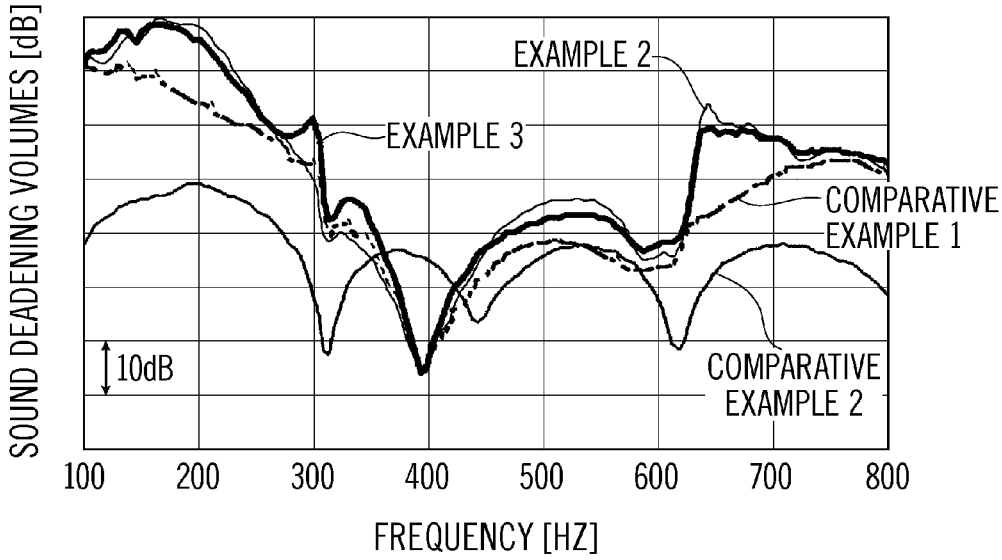
FIG. 9 is a graph also representing a result of experiment for adjusting frequency of the intake sound adjusting device according to the present invention.

FIG. 9 is a graph representing a relationship between the frequencies and the sound deadening volumes in Examples 2 and 3 in a case where the length of the controlling portion 32 along the extending direction of the branch passage 20 is changed. Herein, in the Example 2, the oscillating member 30 having the controlling portion 32, of which length was made smaller than that in the case of the Example 1, was used, and in the Example 3, the oscillating member 30 having the controlling portion 32, of which length was made longer than that in the case of the Example 1, was used. Further, in this experiment, the results of the experiments performed by using the Comparative Examples 1 and 2 were the same as those in the experiment results shown in FIG. 6.

As can be seen from FIG. 9, in the Example 2, the sound deadening volume is made large in the high frequency range more than 400 Hz, and it is found that the controlling portion 32 having short length is effective for achieving the sound deadening effect in the high frequency range. On the other hand, in the Example 3, the sound deadening volume is made large in the high frequency range less than 400 Hz, and it is found that the controlling portion 32 having long length is effective for the sound deadening effect in the low frequency range.

As mentioned hereinabove, by constructing the oscillating member 30 so that the inserting position of the oscillating member 30 is changeable in the branch passage 20 along the extending direction thereof, the specific frequency can be easily adjusted, and the sound quality tuning of the intake pulsating sound can be performed. Furthermore, by changing the length of the controlling portion 32 along the extending direction of the branch passage 20, the frequency band, which is desired to be more deadened in sound, can be adjusted, and hence, the sound quality tuning of the intake pulsating sound can be effectively performed.

Figure 10:
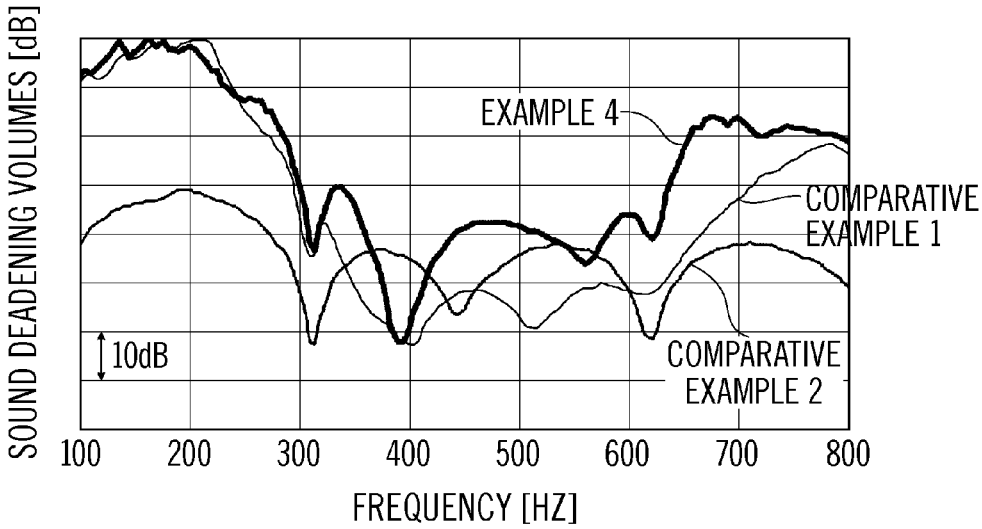
FIG. 10 is a graph representing a result of experiment for adjusting frequency of a modified intake sound adjusting device according to the present invention.

FIG. 10 is a graph representing a relationship between the frequency and the sound deadening volume in Example 4 in which the shape of the oscillating portion 31 was changed. In the Example 4, an oscillating member 30*a* composed of a flat-shaped oscillating portion 31 and a flat-shaped controlling portion 32, which shows substantially T-shape in section as shown in FIG. 4, was used. Further, in this experiment, the results of the experiments performed by using the Comparative Examples 1 and 2 were the same as those in the experiment results shown in FIG. 6 or 9.

As can be seen from FIG. 10, in the Example 4 and the Comparative Example 1, the sound deadening volume is reduced near the specific frequency of 400 Hz and the sound volume in this frequency band region is made large. Furthermore, the sound deadening volume in the frequency band of more than 400 Hz in the Example 4 is larger than that in the Comparative Example, and thus, the sound volume in the frequency band other than the specific frequency is suppressed. As mentioned above, even if the shape of the oscillating portion 31 is changed, the advantageous effect of the intake sound adjusting effect of the intake sound adjusting device of the present embodiment can be also achieved.

As mentioned hereinbefore, according to the intake sound adjusting device of the present invention, the sound quality can be tuned so as to obtain an intake pulsating sound emphasizing only the specific frequency with a simple structure, and it becomes possible to vanish frequency band ranges causing offensive noises or vehicle exterior noises. Therefore, in the sound quality tuning operation, the specific frequency ban can be easily changed.

It is further to be noted that the present invention is not limited to the described embodiment and many other changes and modifications may be made without departing from the scopes of the appended claims.

For example, in the described embodiment, although the oscillating portion 31 and the controlling portion 32 are formed of rubber, only either one of them may be formed of rubber, or either one of them may be formed of synthetic resin.

Furthermore, in the present embodiment, although branch passage (channel) 20 is formed in shape of tube, a porous plate may be attached to the open end 21 of the branch passage 20, or the open end 21 may be branched into a plurality branched passages which may be optionally changed in lengths to thereby adjust the sound quality of the intake pulsating sound.

What is claimed is:

1. An intake sound adjusting device comprising:

an intake passage;

a tubular branch passage extending in a longitudinal direction branching from the intake passage; and an oscillating member disposed within the branch passage, the oscillating member having i) an oscillating portion shaped for closing an interior of the branch passage and ii) a controlling portion shaped as a flat plate extending from the oscillating portion along the longitudinal direction of the branch passage, wherein a position of the oscillating portion inside the branch passage along the extending direction thereof is changeable.

2. The intake sound adjusting device according to claim 1, wherein the controlling portion extends from the oscillating portion toward the intake passage.

3. The intake sound adjusting device according to claim 1, wherein the oscillating portion has a length to be changed along the extending direction of the branch passage.

4. The intake sound adjusting device according to claim 1, wherein the oscillating portion has a conical shape projecting from an inner wall side of the branch passage toward the intake passage.

5. The intake sound adjusting device according to claim 1, wherein the oscillating portion is formed into flat-plate shape vertically intersecting the extending direction of the branch passage.

6. The intake sound adjusting device according to claim 1, wherein at least one of the oscillating portion and the controlling portion is formed of resin material.

7. The intake sound adjusting device according to claim 1, wherein at least one of the oscillating portion and the controlling portion is formed of rubber.

8. The intake sound adjusting device according to claim 1, wherein the controlling portion has a length along the longitudinal direction of the branch passage toward the intake passage configured so that the controlling portion oscillates at a predetermined frequency.

* * * * *